United States Patent [19]

Simpson

[11] Patent Number: 4,565,055

[45] Date of Patent: Jan. 21, 1986

[54] HALTER SAVER

[75] Inventor: Roy G. Simpson, Cookeville, Tenn.

[73] Assignee: Adams Plastics, Inc., Cookeville, Tenn.

[21] Appl. No.: 652,217

[22] Filed: Sep. 19, 1984

[51] Int. Cl.[4] ..... B68B 1/02

[52] U.S. Cl. ..... 54/24

[58] Field of Search ..... 54/6 R, 12, 13, 24

[56] References Cited

U.S. PATENT DOCUMENTS

| | | | |
|---|---|---|---|
| 1,498,397 | 6/1924 | Moyer | 54/24 |
| 3,263,399 | 8/1966 | Faragher | 54/24 |
| 3,306,006 | 2/1967 | Stafford | 54/24 |
| 3,731,456 | 5/1973 | Hill | 54/24 |
| 4,324,089 | 4/1982 | Hart et al. | 54/24 |

*Primary Examiner*—Robert P. Swiatek

*Attorney, Agent, or Firm*—Luedeka & Neely

[57] ABSTRACT

A halter saver for use with a halter and halter lead is disclosed. The halter saver includes a headpiece which encircles the head of the horse having a midsection which passes over the poll and two cheek portions which extend through the cheek rings of the halter to a position beneath the nose. A brow piece extends between and slidably connects to the cheek portions of the headpiece at the brow. A connector strap connects between the brow piece and the poll strap of the halter and slidably connects to the midsection of the headpiece. The halter saver operates to maintain the poll strap of the halter at the poll and, when tension is applied to the halter lead, pressure is applied at the poll for more effective control when the horse is lead and to prevent damage to the halter when the horse is tied.

6 Claims, 4 Drawing Figures

HALTER SAVER

The present invention relates to horse tack and particularly relates to a halter saver for use with a halter and halter lead for preventing a horse from breaking or damaging a halter when tied and to facilitate control over the horse when the horse is being led.

Generally, halters used to tie or to lead horses are made from leather or nylon straps including a poll strip for extending over the poll of the horse, a noseband, two cheek pieces, a throat strap and a lead strap. Halters usually have several rings, e.g., the cheek rings, which is used to interconnect various parts of the halter. The poll strap usually has a buckle for fitting and removing the halter and for adjusting the poll strap to fit the horse. A halter lead is secured to the halter usually at a lead ring which is incorporated into the noseband at its lowermost position. When a horse resists being led by the halter lead or pulls on the halter when tied, force is distributed to various parts of the halter including the poll strap. When the poll strap is in a proper position over the sensitive poll of the horse, pressure is applied to the poll and the halter is effective for tying or leading the horse.

One problem associated with halters is that the poll strap often does not stay in position over the poll and instead slides down on the neck of the horse. Also, a horse pulling against the halter lead may cause the poll strap to slide down the horse's neck by extending its head forward and then raising it. Since the muscles used to support its head are in its neck, the horse is not sensitive in that area and the horse is able to exert great amounts of force on the poll strap without discomfort. Consequently, the horse may damage the halter by breaking or bending the poll strap buckle or by tearing out one of the holes in the poll strap used for attaching the buckle. Even if the halter is not damaged, a horse is often difficult to control when the poll strap is not in the proper position.

It is accordingly an object of the present invention to provide a halter saver for use with the halter and halter lead which maintains the poll strap in a position over the poll and prevents a horse from breaking or damaging the halter. It is a further object of the present invention to provide a halter saver for facilitating more effective control of the horse when being led and for enabling a horse to be tied more effectively. It is another object to provide a halter saver for facilitating halter training when breaking a horse.

These and other objects will become more fully apparent as the following description is read in conjunction with the drawings in which.

Generally, in accordance with the present invention the halter saver includes a headpiece having a midsection for passing over the poll of a horse and two cheek portions for extending downwardly and forwardly along the horses cheeks through the cheek rings. The cheek portions are secured at a position below the horse's nose with the headpiece encircling the head of the horse so that a halter lead may be attached to the headpiece. A brow piece extends between and is slidably connected to the cheek portions of the headpiece for placement over the brow. A connector piece is attached to said brow piece for extending between the brow piece and the poll strap of the halter for extending over the horse's head between the ears. The headpiece is slidably secured to the connector piece adjacent to the poll strap of the halter. The halter saver is operable to maintain the poll strap of the halter at the poll and, because the halter lead is connected to the headpiece, the headpiece applies pressure at the poll when tension is applied to the halter lead. Consequently, the halter saver minimizes the risk of damage to a halter and facilitates secure tying and control of the horse with the halter lead.

Figure 1:
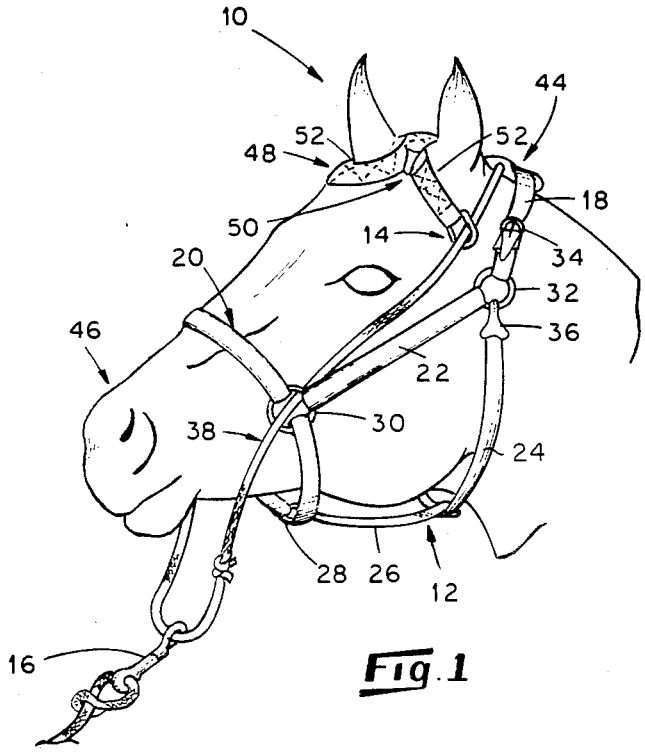
FIG. 1 is a perspective view of a horse's head fitted with a halter, halter lead, and a halter saver embodying one form of the present invention.

Referring now to the drawings in which like reference characters designate like or corresponding parts throughout the several views, there is shown in FIG. 1 a horse's head 10 on which is fitted a halter 12 and one form of the halter saver 14 of the present invention. A halter lead 16, used for tying or leading the horse, is shown attached to the halter saver 14.

Referring still to FIG. 1, it is shown that the halter 12 is of a conventional type and is made from leather or nylon straps including a poll strap 18, a noseband 20, two cheek pieces 22 (one of which is shown), a throat strap 24 and a lead strap 26. A halter 12 of this type is usually connected to the halter lead 16 by means of a lead ring 28 which is incorporated into the lower portion of the noseband 20 and is connected to the lead strap 26. The halter 12 further includes two cheek rings 30 (one of which is shown) which are incorporated into the noseband 20 and connect to the cheek pieces 22. In addition, there are two throat rings 32 (one of which is shown) which connect the poll strap 18 to the cheek pieces 22 and the throat strap 24. The poll strap 18 has a poll strap buckle 34 for removing and fitting the halter 12 and for adjusting the poll strap 18. The throat strap 24 has a throat strap snap 36 which enables the throat strap to be disconnected from the throat ring 32 for fitting and removal of the halter.

Figure 2:
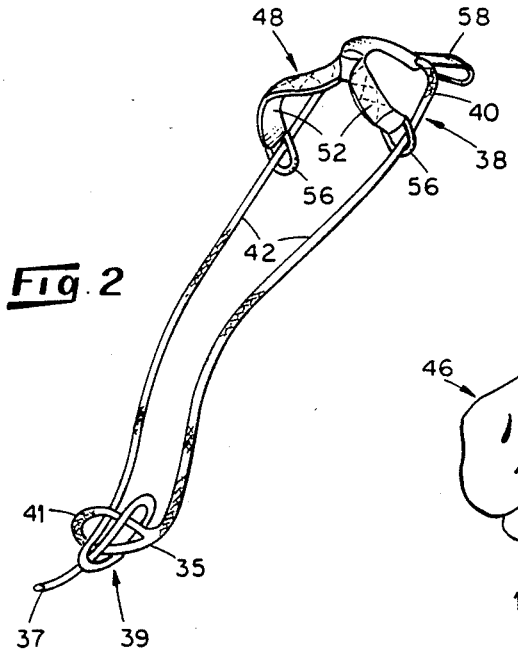
FIG. 2 is a perspective view the halter saver of FIG. 1.

Referring to FIGS. 1 and 2 it is shown that the halter saver 14 includes a headpiece 38 which has a midsection 40 and two cheek portions 42. The midsection 40 is made to fit over the poll of the horse, designated by the numeral 44, and the cheek portions 42 extend downwardly and forwardly through the cheek rings 30 to a position beneath the horse's nose, designated by the numeral 46. The two cheek portions 42 are secured adjacent their ends so that the headpiece 38 encircles the head 10 of the horse. The halter lead 16 may be simply clipped onto the headpiece 38 and tension applied to the halter lead 16 is transferred to the headpiece and pressure is applied to the poll 44 of the horse. Preferably, the headpiece is made from a flexible, cylindrically-shaped elongated member such as rope or cable with a resilient covering. A flexible cylindrically-shaped headpiece is operable to effectively transfer pressure to the poll 44 along a small surface area. Most preferably the headpiece 38 is made from 5/16 inch nylon rope.

In the preferred form of the invention one of the cheek portions 42 of the headpiece 38 has a looped end 35 and the other has a free end 37, the right and left orientation of the ends 35 and 37 not being of importance to the invention. The looped end 35 is suitably provided by tying a knot in the rope such as a bowline knot or by employing a suitable rope fastener. The free end 37 is preferably tied to the looped end 35 in a knot 39, preferably a lock knot as illustrated in FIG. 2, so that the headpiece encircles the head of the horse.

In FIGS. 1 and 2 it is shown that the halter saver 14 further includes a brow piece 48. The brow band 48 is operable to extend across the horse's brow 50 is slidingly connected to the cheek portions 42 of the headpiece 38. In the preferred form of the invention as most clearly shown in FIG. 3, the brow piece 48 is provided by two brow straps 52 of substantially equal length joined by a central ring 54. The brow straps 52 are preferably slidingly connected to the cheek portions 42 of the headpiece 38 with brow D-rings 56. The brow straps 52 are suitably fabricated from one-inch nylon straps which are folded over and sewn to provide loops to receive and secure the central ring 54 and the brow D-rings 56 to the straps 52.

Figure 3:
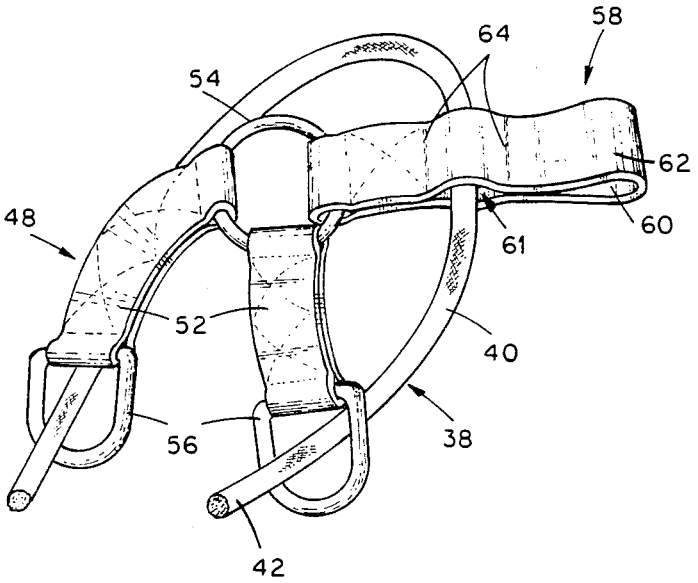
FIG. 3 is a detailed view of the upper portions of the halter saver shown in FIGS. 1 and 2.

FIGS. 1 and 2 show that a connector piece 58 is connected to the brow piece 48 and is operable to connect to the poll strap 18 of the halter 12. The headpiece 38 is slidably connected to the connector piece 58, preferably at a location intermediate the brow piece 48 and the poll strap 18 of the halter 12. The connector piece 58 is operable to pass between the horse's ears and to support the poll strap 18 of the halter in a position at the poll 44 of the horse. The connector piece 58 is also operable to maintain the headpiece 38 at the poll 44 of the horse. As shown most clearly in FIG. 3, the connector piece 58 preferably provides a poll strap loop 60 for slidingly receiving the poll strap 18. In addition the connector piece 58 preferably provides a headpiece opening 61 for receiving and slidably securing the headpiece 38. The connector piece 58 is preferably formed from a doubled-over strap 62 as is shown in FIG. 3 and is suitably made from one-inch nylon strap. The doubled-over strap 62 thus provides two layers which are preferably sewn together at two spaced-apart stitch lines 64 in an intermediate area of the doubled over strap 62 to provide both the poll strap loop 60 and the headpiece opening 61. As shown, it is further preferable for the connector piece 58 to be secured to the central ring 54 by the ring being disposed within the doubled-over portion of the strap 62. The connector strap 58 is thus joined to the brow straps 52 in a Y-shaped configuration as shown. In addition, the connector strap 58 is preferably approximately the same length as the brow straps 52 and the headpiece openings 61 is located at the approximate midpoint of the connector strap 58.

To use the preferred form of the present invention, the halter 12 is fitted on the horse's head 10 in the usual manner. The halter saver 14 is fitted by first threading the free end 37 of the headpiece 38 through one of the cheek rings 30 of the halter 12 upwardly along the horse's cheek and then through one of the brow D-rings 56. The headpiece 38 is passed over the poll 44 of the horse and through the headpiece opening 61 in the connector piece 58 and the free end 37 is threaded downwardly through D-ring 56 and the cheek ring 30 on the other side of the horse's head. The free end 37 is tied into the looped end 35 with a lock knot 39 as shown in FIG. 2. The poll strap 18 is unbuckled at the poll strap buckle 34 and the poll strap 18 is threaded through the poll strap loop 60 of the halter saver 14. With the headpiece 42 encircling the horse's head the halter lead 16 may be attached to the headpiece 38. The horses is led or tied by the halter lead 16.

Figure 4:
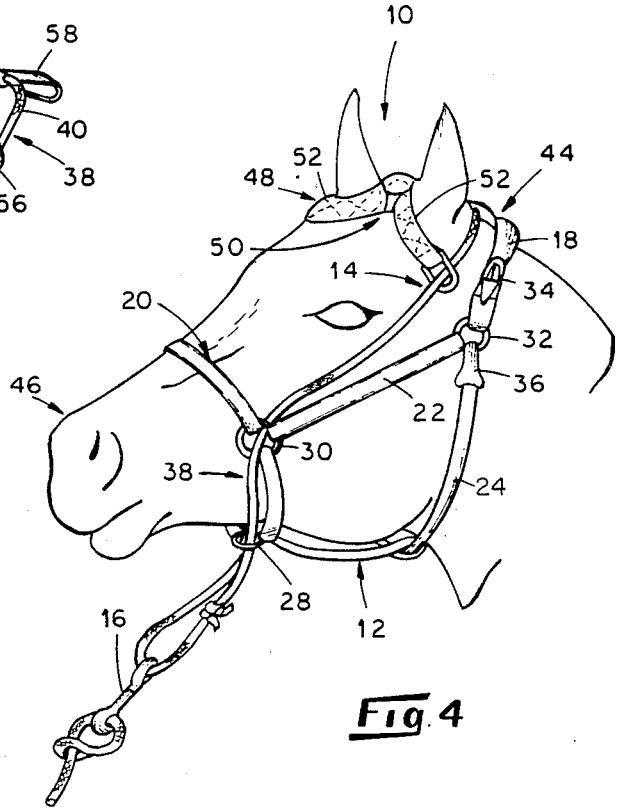
FIG. 4 is a perspective view of a horses head fitted with a halter, halter lead, and the halter saver as shown in the preceding drawings with the headpiece threaded through the lead ring of the halter.

As shown in FIG. 4 the halter saver 14 of the present invention may alternately be fitted on the horse's head 10 with the headpiece also extending through the lead ring 28. The free end 37 of the headpiece 38 is threaded to the halter 12 and to the other portions of the halter saver 14 in a similar manner as shown in FIG. 1 except that the free end 37 is first threaded through the lead ring 28 before being threaded through the cheek ring 22. Also, the free end 37 is threaded through the lead ring before being tied to the looped end 35 to result in the configuration shown in FIG. 4. In both configurations, FIG. 1 and FIG. 4, a halter saver 14 of the present invention is operable to maintain the poll strap 18 at the poll 44 of the horse and provides a secure attachment point for receiving the halter lead 16. Whenever tension is exerted on the halter lead 16, pressure is applied at the poll 44 of the horse by the midsection 40 of the headpiece 38. When the horse is tied, this pressure prevents the horse from pulling hard against the halter 16 and, in addition, because the poll strap 18 is maintained at the poll 44 of the horse, the horse is unable to damage or break the halter 12. When the horse is being led, the pressure applied at the poll 44 facilitates control over the horse. The halter saver 14 is thus particularly useful when breaking weanlings and is very useful for training a horse to lead and to tie. In the configuration shown in FIG. 4 the halter saver 14 is further operable to hold the horses head down. Because the headpiece 38 is slidably attached to the other parts of the halter saver 14 and the halter 12, the headpiece 38 does not distort the halter 12.

The halter saver 14 of the present invention may be used with essentially all conventional halters to provide significant advantages in handling and tying horses. The halter saver 14 is fitted on the horse without any modification or damage to the halter 12.

Although a particular embodiment of the present invention has been described in the foregoing description, it will be understood that the invention is capable of numerous modifications without departing from the spirit of the invention.

What is claimed is:

1. A halter saver for use with a halter and halter lead, the halter having cheek rings and a poll strap comprising:

a headpiece for extending over the horse's head having a midsection and two cheek portions, said midsection passing over the poll of the horse and said cheek portions extending downwardly and forwardly along the horse's cheeks through the cheek rings of the halter and being joined together beneath the horse's nose with said headpiece encircling the head of the horse so the halter lead may be attached to said headpiece;

a brow piece for placement over the brow of the horse extending between and being slidably connected to said cheek portions of said headpiece; and a connector piece for extending over the head of the horse between the ears and having a first end connected to a central area of said brow piece and a second end for connecting to the poll strap of the halter, said connector piece being slidably attached to the midsection of said headpiece at a location on said connector piece intermediate said first and second ends;

whereby the poll strap of the halter is maintained at the poll of the horse and said headpiece is free to slide with respect to said connector piece, brow piece, and halter and is operable to apply pressure at the poll of the horse when tension is applied to the halter lead.

2. The halter saver of claim 1 wherein said connector piece is a doubled-over strap, said doubled-over strap being secured to provide a loop at the second end for receiving and slidably connecting to the poll strap of the halter.

3. The halter saver of claim 1 wherein said headpiece is a flexible, cylindrically-shaped elongated member.

4. The halter saver of claim 3, wherein said headpiece comprises a rope and said cheek portions terminate at a free end and a looped-end, said free end being tied into said looped end to join the cheek portions of the headpiece.

5. A halter saver for use with a halter and halter lead, the halter having cheek rings and a poll strap comprising:

a headpiece for extending over the horse's head having a midsection and two cheek portions, said midsection passing over the poll of the horse and said cheek portions extending downwardly and forwardly along the horse's cheeks through the cheek rings and joining together beneath the horse's nose, said headpiece encircling the head of the horse so the halter lead may be attached to said headpiece;

a brow piece extending between and being slidably connected to said cheek portions of said headpiece for placement over the brow of the horse; and a connector piece attached to said browpiece and for connecting to the poll strap of the halter, said connector piece connecting said brow piece and the poll strap by extending over the head of the horse between the ears, said connector piece comprising a doubled-over strap providing a central area having two layers, said two layers being secured at spaced apart locations to provide an opening for receiving and slidably securing said headpiece and to provide a loop for receiving and slidably connecting to the poll strap of the halter;

whereby the poll strap of the halter is maintained at the poll of the horse and said headpiece applies pressure at the poll when tension is applied to the halter lead.

6. The halter saver of claim 5, wherein said brow piece comprises two brow straps of substantially equal length said two brow straps being connected together and being joined to said connector piece in a Y-shaped configuration at a central ring, each of said brow straps having a brow ring for slidably attaching said brow straps to said cheek portions of said headpiece.

* * * * *